US008635715B2

(12) United States Patent
Hunt et al.

(10) Patent No.: US 8,635,715 B2
(45) Date of Patent: Jan. 28, 2014

(54) HELMET AND VISOR LOCKING MECHANISM

(75) Inventors: Jeremy Hunt, Clontarf (AU); Jason Cooke, Parkwood (AU)

(73) Assignee: Cookie Composites (AU)

( * ) Notice: Subject to any disclaimer, the term of this patent is extended or adjusted under 35 U.S.C. 154(b) by 192 days.

(21) Appl. No.: 13/019,653

(22) Filed: Feb. 2, 2011

(65) Prior Publication Data

US 2012/0144566 A1 Jun. 14, 2012

Related U.S. Application Data

(60) Provisional application No. 61/421,507, filed on Dec. 9, 2010.

(51) Int. Cl.
*A42B 1/24* (2006.01)

(52) U.S. Cl.
USPC ..... 2/422

(58) Field of Classification Search
USPC ..... 2/6.2, 6.5, 6.8, 421, 422, 425, 15, 451, 2/9
See application file for complete search history.

(56) References Cited

U.S. PATENT DOCUMENTS 4,170,792 A * 10/1979 Higgs ..... 2/10
4,292,688 A * 10/1981 Ellis ..... 2/6.4
4,305,160 A * 12/1981 Sundahl ..... 2/424
4,621,377 A * 11/1986 Pennell ..... 2/6.4
4,907,300 A * 3/1990 Dampney et al. ..... 2/424
5,095,551 A * 3/1992 Chin ..... 2/424
5,184,231 A * 2/1993 Ellis ..... 359/13
5,329,642 A * 7/1994 Dampney ..... 2/424
5,333,329 A * 8/1994 Hong ..... 2/424
5,444,875 A * 8/1995 Taniuchi ..... 2/424
6,622,313 B1 * 9/2003 Choi et al. ..... 2/424
6,732,380 B1 * 5/2004 Lee ..... 2/424
6,795,978 B2 * 9/2004 Fournier et al. ..... 2/424
6,851,129 B2 * 2/2005 Gafforio et al. ..... 2/424
7,225,471 B2 * 6/2007 Sutter et al. ..... 2/6.4
7,555,788 B2 * 7/2009 Schimpf ..... 2/6.5
8,011,025 B2 * 9/2011 Lee ..... 2/424
8,032,946 B2 * 10/2011 Ishikawa ..... 2/6.5

(Continued)

*Primary Examiner* — Alissa L Hoey
(74) *Attorney, Agent, or Firm* — Straub & Pokotylo; Michael P. Straub; Stephen T. Straub

(57) ABSTRACT

A visor locking assembly alone or in combination with a helmet shell and visor. The visor locking assembly is attached to said shell and is used to mount the visor in a manner that allows the visor to be locked in a desired position. The visor locking assembly is configured to prevent the visor from being moved from a fully lowered position to a raised position unless the visor is displaced laterally forward away from the face of the wearer of the helmet. The locking assembly further comprises a body and a rotatable hub, wherein the body comprises a cavity, and wherein the cavity further comprises a protrusion on the wall of the cavity, and wherein the rotatable hub comprises a recess formed along the circumference of the hub. The hub is positioned to rotate within the cavity, and the hub is prevented from rotational movement when the protrusion is positioned within (engaged with) the recess. When the hub is displaced laterally within the cavity away from the protrusion, the hub becomes rotatable. A spring is attached to the hub inhibiting said displacement. The system may comprise a single visor locking assembly or two visor locking assemblies on a helmet. If two assemblies are utilized, the visor cannot be raised from a fully lowered position unless both assemblies are unlocked.

15 Claims, 10 Drawing Sheets

(56) References Cited

U.S. PATENT DOCUMENTS

| | | | | |
|---|---|---|---|---|
| 8,056,144 | B2 * | 11/2011 | Gafforio et al. | 2/6.4 |
| 8,082,600 | B2 * | 12/2011 | Morin | 2/424 |
| 8,166,577 | B2 * | 5/2012 | Lee | 2/424 |
| 8,214,919 | B2 * | 7/2012 | Gafforio et al. | 2/6.5 |
| 8,286,270 | B2 * | 10/2012 | Higgins | 2/422 |
| 8,291,513 | B2 * | 10/2012 | Prinkey | 2/15 |
| 2003/0088907 | A1 * | 5/2003 | Gafforio et al. | 2/424 |
| 2003/0182716 | A1 * | 10/2003 | Wu | 2/424 |
| 2004/0049830 | A1 * | 3/2004 | Gafforio et al. | 2/171 |
| 2006/0057972 | A1 * | 3/2006 | Wikel et al. | 455/90.3 |
| 2006/0117467 | A1 * | 6/2006 | Choi et al. | 2/424 |
| 2007/0074335 | A1 * | 4/2007 | Gafforio et al. | 2/410 |
| 2007/0124851 | A1 * | 6/2007 | Pyo | 2/424 |
| 2008/0196148 | A1 * | 8/2008 | Morin | 2/421 |
| 2008/0216215 | A1 * | 9/2008 | Lee | 2/424 |
| 2009/0300813 | A1 * | 12/2009 | Ishikawa | 2/15 |

* cited by examiner

HELMET AND VISOR LOCKING MECHANISM

RELATED APPLICATION

The present application claims the benefit of U.S. Provisional Patent Application Ser. No. 61/421,507, filed Dec. 9, 2010 which is hereby expressly incorporated by reference in its entirety.

FIELD OF THE INVENTION

The invention relates to visor locking mechanisms suitable for use on helmets and, more particularly, to visor locking mechanisms which lock in a reliable manner and are suitable for a wide range of applications including, e.g., skydiving and/or motor cycle helmets.

BACKGROUND OF THE INVENTION

Full-face skydiving helmets with fixed face visors were developed and entered the market in the early 1990s. These fixed visor helmets did not allow the wearer to open the face shield while being worn. Flip up visor helmets entered the market in approximately 1995, however the mechanisms used to keep the face shield locked while traveling at speeds of, for example, +300 km/hr were rudimentary and resulted in many visors inadvertently opening during freefall. Such locking mechanisms were often the same as or similar to those used in motorcycle helmet designs.

The airflow that travels over a wearer's helmet while skydiving in a face to earth position is different than that experienced while riding a motorcycle. As a result the use of known motorcycle type face shield lock mechanisms often failed to remain closed during use.

In view of the above discussion, it should be appreciated that there is a need for improved visor locking mechanisms that are well suited for skydiving helmets. While improved locking mechanisms are needed with regard to skydiving helmets, improved locking mechanisms may also be useful for other types of helmets including motorcycle helmets.

It is an object of the present invention to address the problems of the existing protection devices as are described above, and provide a protective helmet with a rotatable visor or face shield that requires two different locking mechanisms to be unlocked before the visor can be raised from a fully down position, such as when skydiving, to prevent inadvertent raising of the visor.

It is another object of the present invention for a single locking mechanism that will allow a face shield to be rotated upward when the single lock is disengaged, to make the face shield more convenient for less hostile environments, such as when riding a motorcycle.

It is another object of the present invention for the locking mechanism to be simple to operate, such as when a user is wearing gloves, easy to assemble and disassemble, and inexpensive to manufacture.

It is another object of the present invention to utilize two locking mechanisms under certain conditions such that if one mechanism fails, the other prevents the visor from being inadvertently raised.

It is another object of the present invention for the visor to be easily locked in place when lowered to a fully down position.

SUMMARY OF THE INVENTION

According to the present invention, there is provided a system or apparatus for preventing the inadvertent raising of a rotatable visor or face shield on a helmet, for use in various activities such as motorcycling or skydiving. The helmet visor locking mechanism and helmet incorporating such a mechanism is in response to the need for improved visor locking mechanisms for use in the sports of skydiving/parachuting where there is often a need for helmet visors and mechanisms to withstand high speeds while still being easy to flip up and locked down during use. In some cases the helmets and visor are intended to withstand speeds up to 300 km/hr.

In one form of the invention, where redundancy is less important, a single locking mechanism is provided to be used on one side of the helmet, with a simple hinge or pivot being used on the other side instead of the locking assembly of the present invention. Such embodiments are well suited for environments where there is little danger of inadvertent raising of the face shield, such as when riding a motorcycle, where the stresses placed on the helmet and visor are often lower than those encountered in the case of skydiving helmets. In such a case, the wind would be hitting the face shield essentially straight on, and therefore there would be no expectation of the wind causing the visor to inadvertently rotate upward. In this embodiment, the user can disengage or unlock the locking mechanism using one hand, and once unlocked, the face shield can be raised or rotated upward from a fully closed or fully down position.

Conversely, in an activity such as skydiving, the relative wind on the face mask would generally be both stronger, and would strike the face mask from a multitude of possible angles, such as when the skydiver is tumbling during a freefall. In such a case, the user would not want the wind to inadvertently cause the face shield to rotate upward, exposing the user's face to winds up to or exceeding 300 km/hr. For such a situation, a preferred form of the present invention would be the provision of two locking mechanisms; one on each side of the helmet. The two locking mechanisms are identical in some but not necessarily all embodiments. The visor locking mechanisms, sometimes referred to as visor lock assemblies, are fitted one to each side of a helmet in a position that facilitates the rotation of the visor as to clear the helmet on opening. These visor lock assemblies are either recessed into the helmet or mounted externally using screws or bolts, depending on the particular embodiment. This embodiment of the invention would prevent the visor from inadvertently raising if only one of the two mechanisms were unlocked or failed. This embodiment would require the user to unlock both mechanisms before the visor could be raised (rotated upward).

The locking mechanism of a preferred form of the present invention would be simple to operate, intuitive, and easy to assemble and disassemble. To open the visor the wearer places either the palms of the hand or index finger and thumb on the visor locking plates on either side of the helmet. Each plate would preferably be formed to allow fingers to easily grip it and rotate it. Grasping the visor locking plates the user pushes the visor forward to the unlocked position. With the visor held forward in this position it can then be rotated up and clear of the peripheral view, or to an intermediate position between fully open and fully closed. Once the visor begins rotating upward, the visor no longer is required to be held forward by the user.

To close the visor the user will grasp the face shield and rotate downward. As the Hub engages the locking pin the visor will spring back into its locked position.

In some embodiments, the visor locking mechanism includes: a body, an axle, a hub, a locking pin, a spring and a visor locking plate. In some embodiments the body is a plastic or machined aluminum part that provides a housing to contain the axle, hub, locking pin and spring. The body is manufactured to have clearance for the movement of both axle and hub. In some embodiments the axle is a plastic or machined aluminum part that allows the mechanism to rotate around its center and features a disc that creates the assembly's stability. The axle has a countersunk hole that enables it to be fastened to the hub. The center of the axle acts as a pin for one end of the spring.

In some embodiments the hub is a machined aluminum part. In the exemplary embodiment the hub has three raised bosses and screw holes that allow the visor locking plate and visor to be screwed to it. The hub, in some implementations, has a thread, e.g., a 5 mm thread, in it's centre as well as a spigot that allows the axle to be fastened to it. The mounting bosses act to locate the visor in the correct position. The hub has a tapered recess on one side that is designed to match the locking pin. The hub is under constant tension from the spring and in its locked position has no movement due to the recess' taper. The locking pin in some implementations is integrated into the body. The locking pin's purpose is to lock the hub in place as well as offer a low friction surface for the hub to rotate under spring tension when the visor is being rotated up and down.

The spring, in some implementations is implemented from a flexible material and may be in the form of a compressible ring, e.g., a 2.5 mm thick polyurethane ring. The polyurethane's hardness dictates its elasticity. A material with a hardness that provides adequate force to return the hub onto the locking pin and keep tension while locked is used.

The visor Locking plate acts to retain the visor between itself and the hub. The visor locking plate's shape acts as a finger grip and allows the user an area to easily hold while both pushing forward and rotating the visor into the open position.

The particular described embodiment is intended to be exemplary in nature and not necessarily limiting in terms of the scope of the invention.

Numerous additional features, benefits are discussed in the detailed description which follows.

DESCRIPTION OF A PREFERRED EMBODIMENT

Figure 1A:
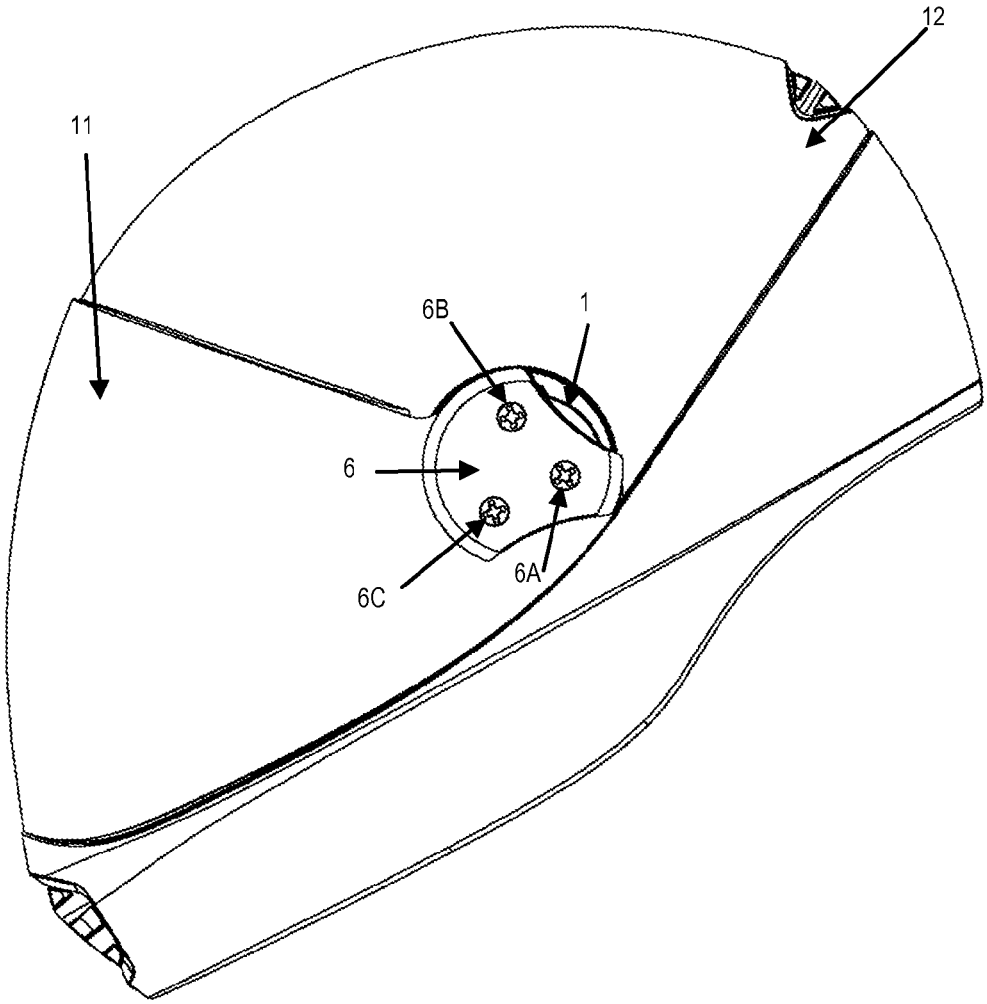
FIG. 1A illustrates a helmet assembly including a visor in the fully down position and an exemplary visor locking assembly, implemented in accordance with one embodiment of the invention, in the locked position.
Figure 1B:
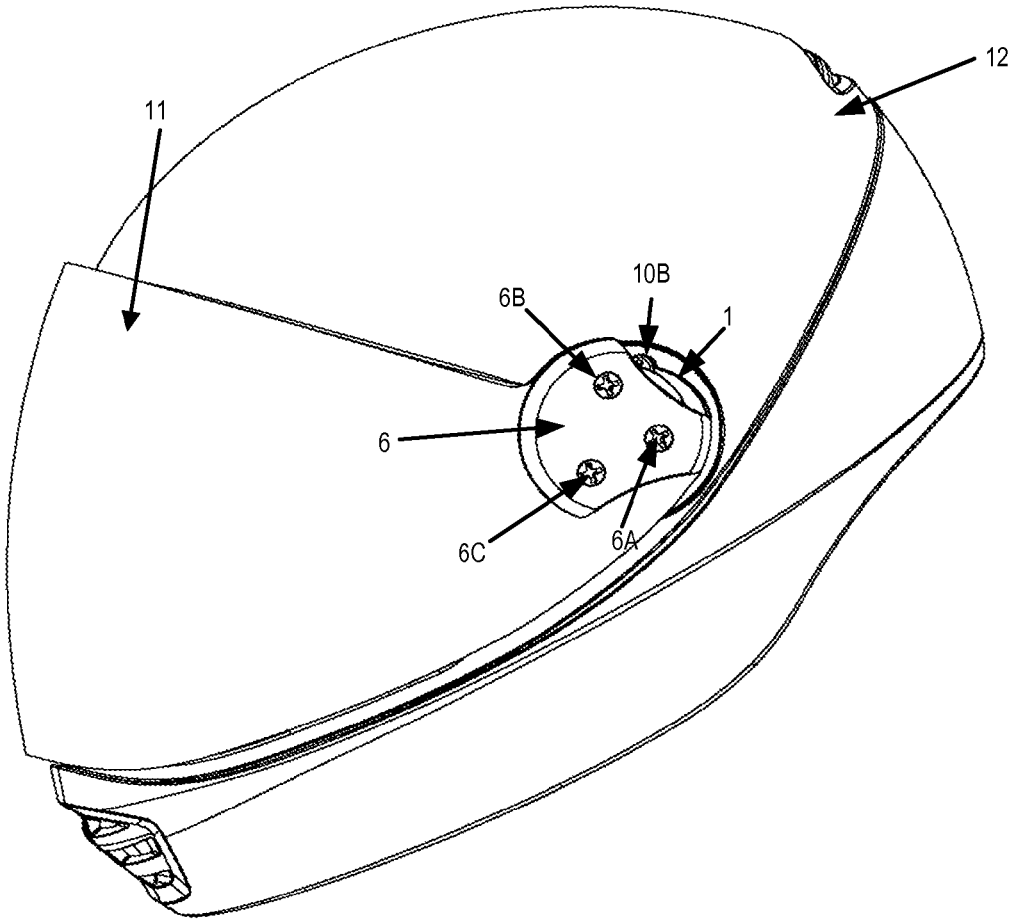
FIG. 1B illustrates the helmet assembly shown in FIG. 1A, but with the visor pulled slightly forward so that the visor is unlocked and ready for rotation.

Referring to the drawings, FIG. 1A shows a helmet assembly including a helmet 12 with a visor 11 (or face shield) in a closed, lowered, or fully down position with the visor pushed fully back thereby placing the visor lock assembly in a locked position. Visor locking plate 6, sometimes referred to as a gripping member, can be grasped by the wearer of helmet 12 and moved laterally forward (moving visor 11 away from the face of the wearer), thereby unlocking the locking mechanism. FIG. 1B shows the helmet assembly of FIG. 1 with the visor pulled forward so that it is in the unlocked position and ready for rotation. Screws 6A, 6B, and 6C, shown in FIGS. 1A and 1B, advantageously mount the visor locking plate 6 to the hub which can be seen in FIG. 2, while allowing the hub to rotate around body 1. Screw 10B which is slightly visible is illustrated more clearly in FIG. 3 and is used, along with another screw, to mount body 1 onto helmet 12.

Figure 2:
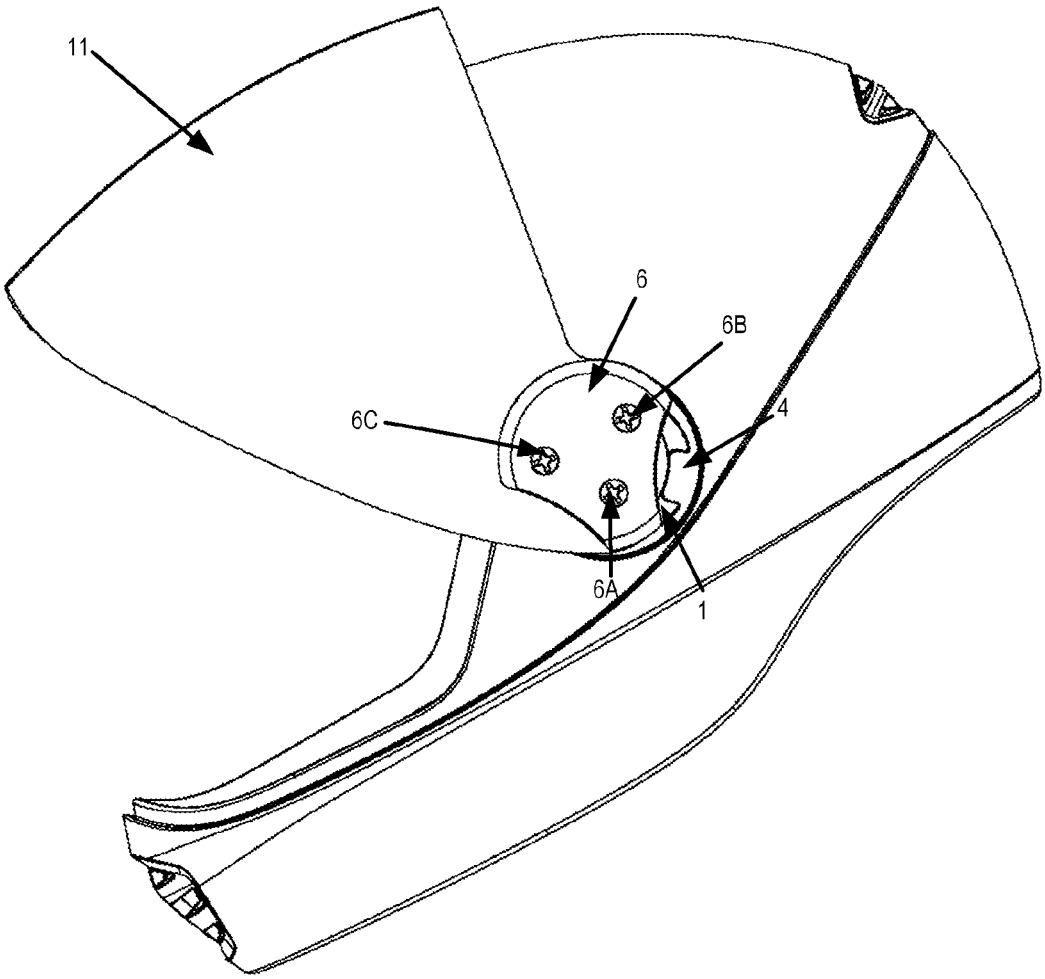
FIG. 2 illustrates the helmet of FIG. 1 with the visor in the fully raised or open position.

FIG. 2 shows the helmet of FIGS. 1A and 1B where visor 11 is in a fully raised position. Trigger 4 is now not engaged with the recess of hub 3.

Figure 3:
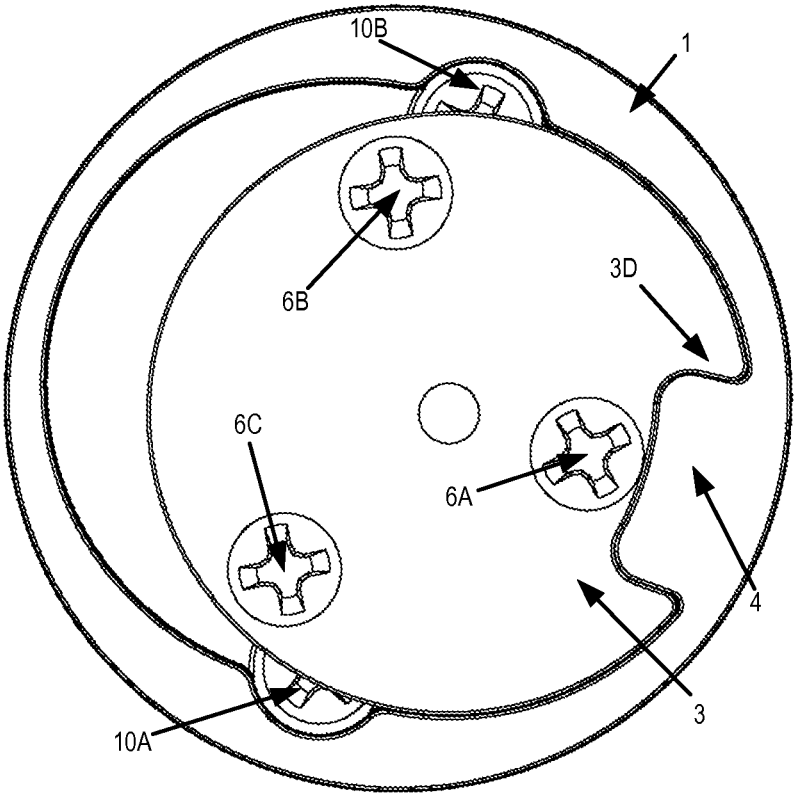
FIG. 3 illustrates the hub and body of the locking assembly with the visor in the fully closed position with the locking pin engaged in the hub's recess.

FIG. 3 shows hub 3, with screws 6A, 6B, and 6C holding hub 3 to locking plate 6 when the visor is completely closed. A protrusion, e.g., Locking pin 4, within a cavity (1E) of body 1 is fully engaged within recess 3D of hub 3, thereby locking the locking assembly. Screws 10A and 10B are used to mount body 1 onto helmet 12.

Figure 4:
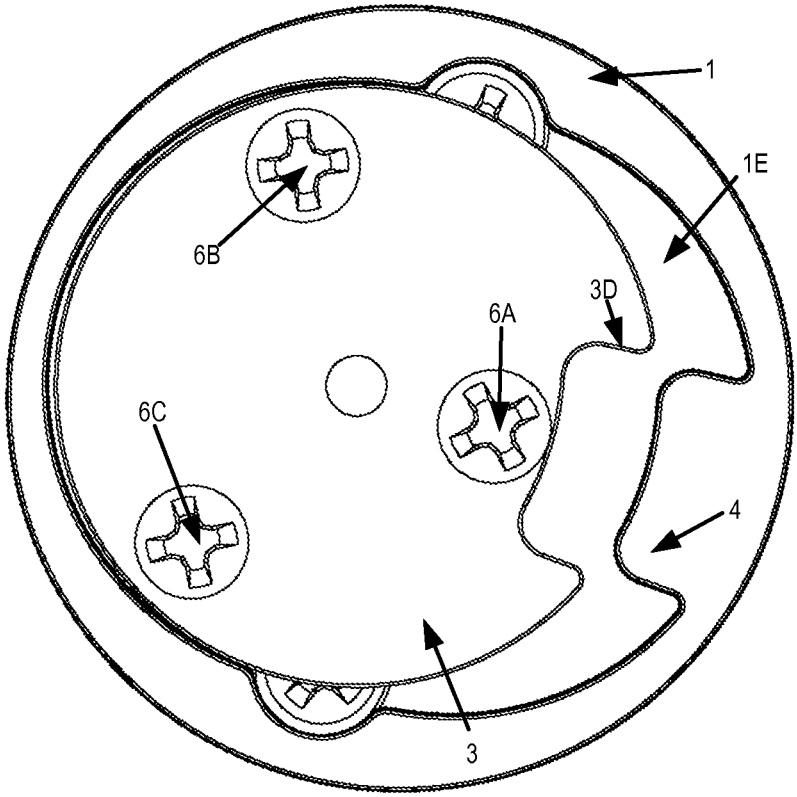
FIG. 4 illustrates the visor lock assembly of FIG. 3 when the visor has been displaced forward, disengaging the locking pin from the recess.

FIG. 4 shows hub 3 displaced laterally away from locking pin 4, such that recess 3D is no longer engaged with locking pin 4, and the locking mechanism is unlocked. This is initiated by the wearer pushing on the visor locking plate 6, displacing visor 11 laterally away from the wearer's face. The face of locking pin 4 is advantageously low friction, allowing hub 3 to rotate freely within cavity 1E of body 1, once recess 3D is displaced from engagement with locking pin 4.

Figure 5:
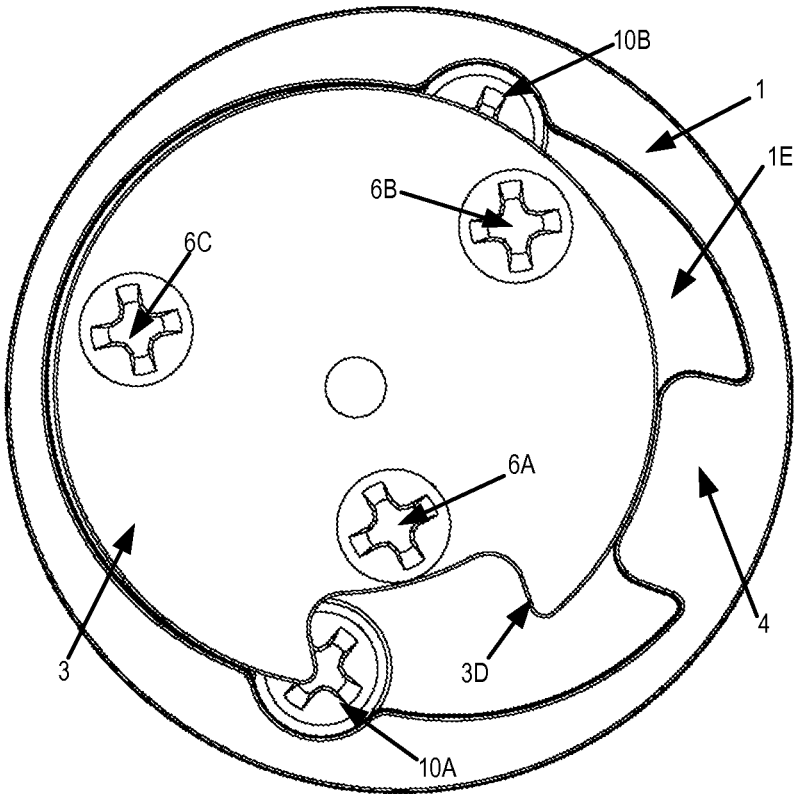
FIG. 5 shows the visor lock assembly of FIGS. 3 and 4 where the visor has been rotated to a raised position, and the locking pin is absorbing the tension of the spring and allowing the hub to freely rotate.

FIG. 5 shows hub 3 displaced laterally away from locking pin 4 and rotated within cavity 1E of body 1, such that visor 11 is in the up, or open position. The surface of hub 3 is in low-friction contact with the surface of locking pin 4, and locking pin 4 is keeping spring 5 stretched, relieving the wearer of the necessity of continuing to push visor 11 forward against the tension of the spring. FIG. 5 further shows that when hub 3 is rotated back to alignment with recess 4, the tension in spring 5 will return locking pin 4 into recess 3D, locking the mechanism in a visor full-down position.

Figure 6:
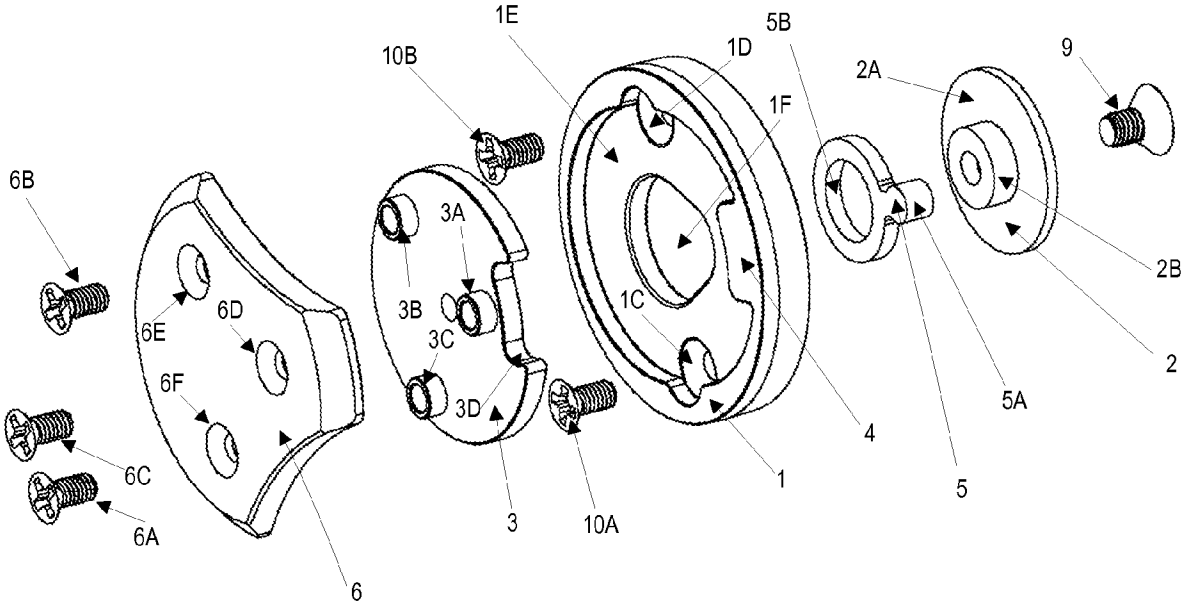
FIGS. 6-7 show the various components of an exemplary visor lock assembly from different viewing positions.

FIG. 6 shows visor locking plate 6 such that bolts 6A, 6B, and 6C can be placed through holes 6F, 6E, and 6D respectively, and mounted into raised mounting bosses 3C, 3B, and 3A respectively. Also from this view it can be seen that hub 3 is situated within cavity 1E of body 1, wherein cavity 1E allows hub 3 to move laterally away from locking pin 4, releasing recess 3D from locking pin 4, unlocking the assembly and allowing hub 3 to rotate within cavity 1E.

It can further be seen that bolt 9 is used to anchor the center 2B of axle 2 through ring 5B of spring 5, through the aperture 1F of body 1, to be fastened to hub 3. Meanwhile, bolts 10A and 10B are positioned in holes 1C and 1D, respectively, to fasten body 1 to helmet 12.

Aperture 1F in body 1 is elongated such that axle center 2B, and hence hub 3, can either be up against the side of aperture 1F closest to locking pin 4, or when spring 5 is stretched, axle center 2B and hub 3 can be displaced away from locking pin 4, such that locking pin 4 no longer prevents hub 3 from rotating, as locking pin 4 is no longer situated within (and therefore engaged with) recess 3D. This positions axle center 2B and hub 3 up against the side of aperture 1F furthest from locking pin 4.

Ring 5B of spring 5 can be fashioned from any suitably elastic material, such as 2.5 mm thick polyurethane.

Figure 7:
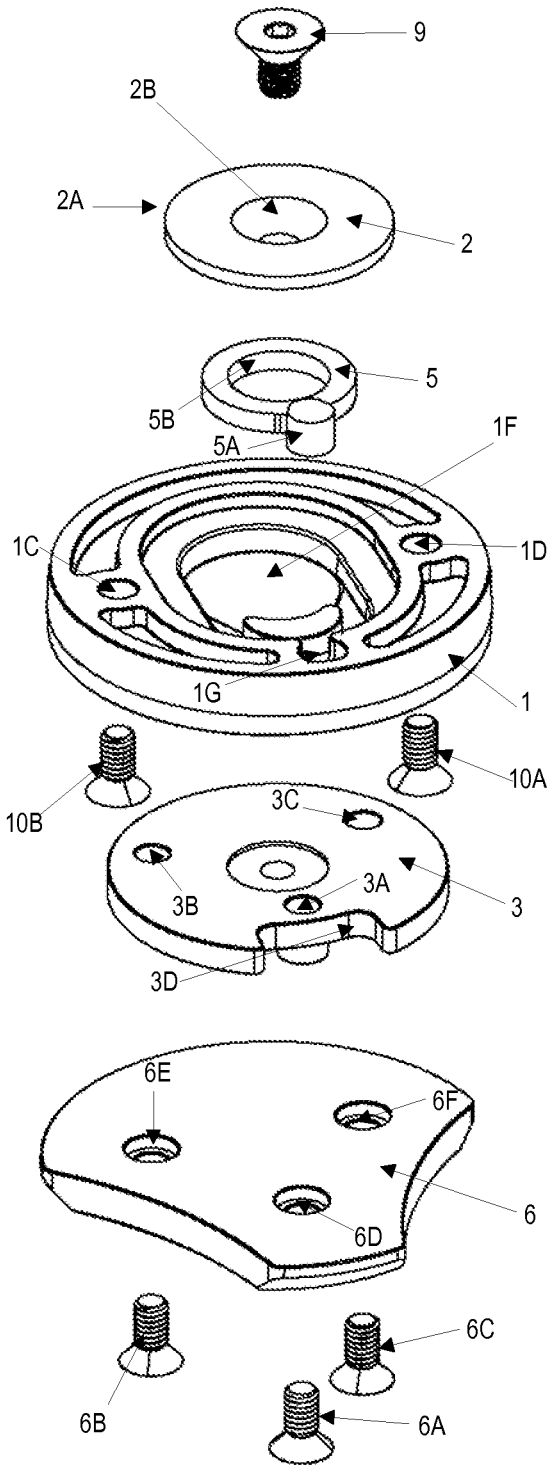

FIG. 7 shows the visor locking mechanism from a different angle, showing that disc 2A of axle 2 is situated inside body 1 to provide stability to the axle, while allowing axle 2 and center 2B to rotate within body 1.

Also shown from this angle is knob 5A on spring 5, which when situated in complementary receptacle 1G of body 1 anchors spring 5 on the side of body 1 closest to locking pin 4. This keeps locking pin 4 within recess 3D, locking visor 11 in the fully down position, until hub 3 is manually pushed against the resistance of ring 5B laterally, disengaging locking pin 4 from recess 3D, allowing visor 11 to be rotated upward.

Figure 8:
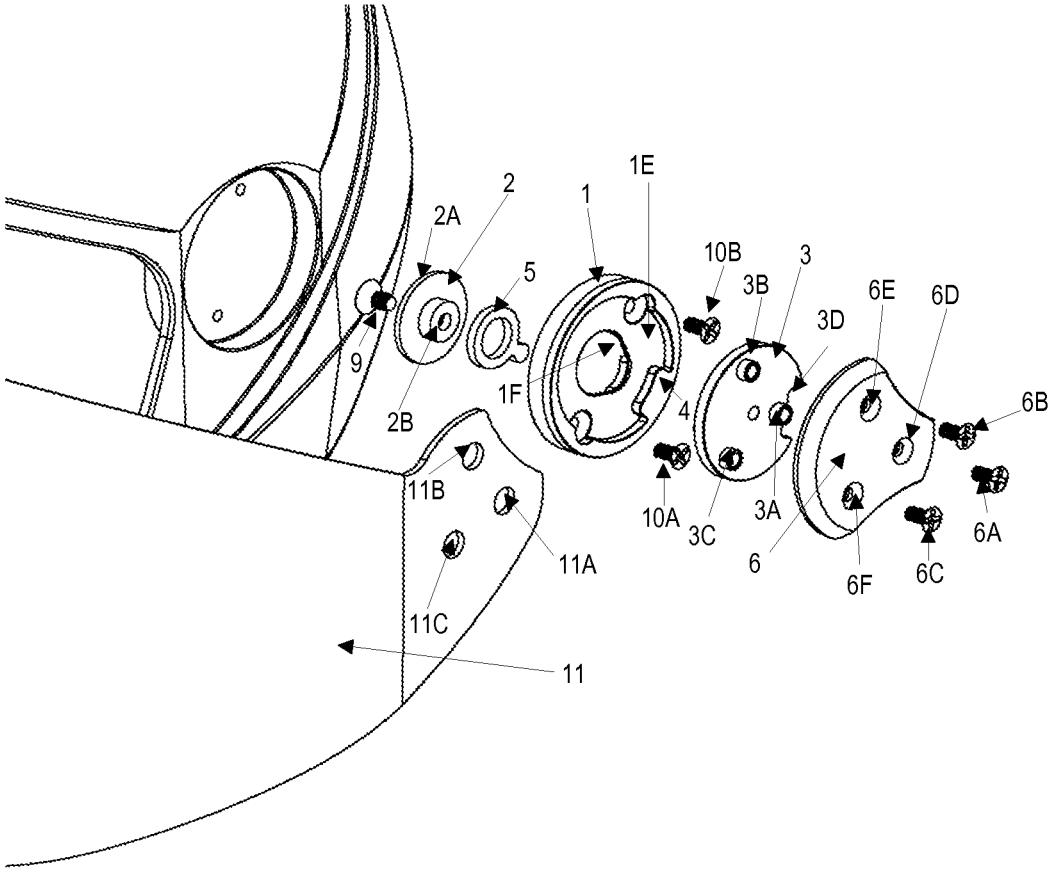
FIG. 8 shows how the visor locking assembly may be combined with a visor and helmet.

FIG. 8 shows the visor locking mechanism in relation to visor 11, whereby bolts 6A, 6B, and 6C attach through holes 11A, 11B, and 11C respectively, fixing visor 11 in a fully down position when recess 3D engages with locking pin 4. It can also be seen that when visor 11 is displaced forward (away from the wearer's face), recess 3D is moved away from locking pin 4, disengaging therefrom, allowing hub 3 to rotate visor 11 upwards toward a fully open or raised position.

Figure 9:
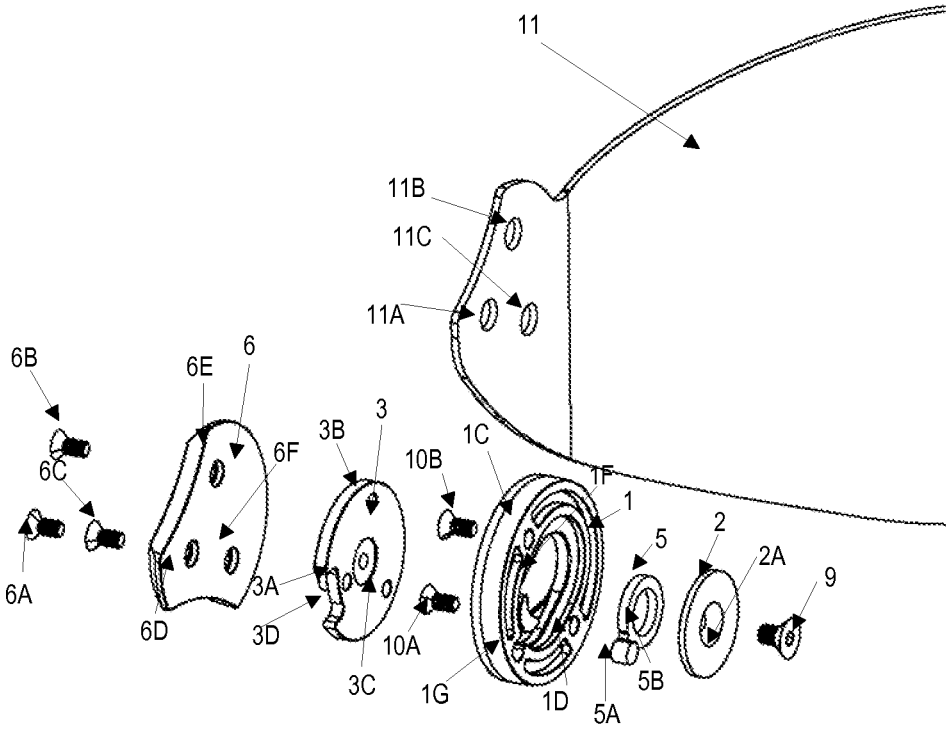
FIG. 9 shows, from a different viewing perspective than is shown in FIG. 8, how the locking assembly of the present invention can be used with a visor.

FIG. 9 shows a different view of the visor locking mechanism with visor 11, showing that when visor 11 is moved laterally forward (away from the wearer's face), ring 5B stretches to accommodate hub 3 moving away from locking pin 4, such that recess 3D is no longer mated or engaged with locking pin 4, thereby allowing hub 3 (and hence visor 11) to freely rotate toward an open position.

When visor 11 is rotated from an open or raised position downward to a lowered or closed position, the tension of ring 5B pulls axle 2, and hence hub 3, back toward locking pin 4, mating recess 3D with locking pin 4, and thereby locking visor 11 in a fully closed position.

In addition to the visor locking mechanism and helmet assembly, the present application is directed to a method of using a helmet of the type shown in FIG. 1. In accordance with the invention to unlock the visor when mounted on the helmet in the locked position a user moves the visor forward to unlock the visor and allow it to rotate. The user may then rotate and raise the visor if desired, moving the visor to a partially or fully raised position. When a user desires to close and lock the visor in the down position, the user rotates the visor down and moves the visor back toward the rear of the helmet to lock it in the closed and lock position.

While the helmet and locking mechanism of the present invention are well suited for skydiving applications, it can also be used as a motorcycle helmet or in a wide variety of other helmet applications. While a visor locking mechanism is included on both sides of a helmet in some embodiments, in other embodiments a visor locking mechanism of the present invention is used on one side of a helmet with a hinge or rotatable mounting device being used on the other side of the helmet. Such embodiments are well suited for motorcycle or other applications where the stresses on the helmet visor may be loser than, for example, in the skydiving embodiment.

Numerous additional features and embodiments are possible and the thus it should be appreciated that the invention is not limited to the particular exemplary embodiments discussed above but may cover other embodiments and applications as well.

What is claimed is:

1. An apparatus for mounting a face shield on a helmet, the apparatus comprising:
   - a circular body including a protrusion extending toward the center of said circular body and into a cavity formed by walls of said circular body extending around a perimeter of the said cavity;
   - a visor locking plate;
   - a hub including a plate and fastening protrusions extending from said plate, said plate including a recess preventing the hub from rotational movement when the protrusion is positioned within the recess, a portion of said face shield being sandwiched between said visor locking plate and said hub;
   - a first fastener for securing the circular body to the helmet; and
   - second fasteners extending into said fastening protrusions for securing the hub to the visor locking plate, and wherein the plate of said hub is positioned within the walls forming the cavity of the circular body, said walls surrounding said plate in one direction.

2. The apparatus of claim 1 wherein the hub is rotatable only when the recess is displaced radially away from the protrusion.

3. The apparatus of claim 2, wherein a spring attached to the circular body resists said displacement.

4. The apparatus of claim 3, wherein an axle is positioned through an aperture in the circular body and attached to the hub.

5. An apparatus for mounting a face shield on a helmet, the apparatus comprising:
   - a body including a protrusion extending into a cavity of the body;
   - a visor locking plate;
   - a hub including a recess preventing the hub from rotational movement when the protrusion is positioned within the recess, a portion of said face shield being sandwiched between said visor locking plate and said hub;
   - a first screw for securing the body to the helmet;
   - a second screw for securing the hub to the visor locking plate, the hub being positioned within the cavity of the body;
   - wherein the hub is rotatable only when the recess is displaced radially away from the protrusion;
   - wherein a spring attached to the body resists said displacement;
   - wherein an axle is positioned through an aperture in the body and attached to the hub; and
   - wherein the aperture is elongated such that there is a first end and a second end such that the axle can be displaced radially between the first end and the second end.

6. The apparatus of claim 5 wherein the spring further comprises an elastic member attached to the axle and wherein the member positions the axle against the first end when the member is not stretched.

7. The apparatus of claim 6 wherein the member is in the form of a ring around the axle.

8. The apparatus of claim 6 wherein the spring further comprises a knob on the member and wherein the knob is positioned within a receptacle of the body.

9. The apparatus of claim 5 wherein when the axle is in the first end of the aperture the protrusion is in the recess.

10. The apparatus of claim 9 further comprising a bolt that positions the axle in the first end when the face shield is in the fully lowered position.

11. The apparatus of claim 5 wherein the axle is in the second end of the body aperture when the protrusion is not in the recess.

12. The apparatus of claim 11 wherein the face shield is attached to the hub and when the face shield is displaced laterally away from the face of a wearer of the helmet, the axle is displaced from the first end to the second end.

13. The apparatus of claim 11, wherein when the axle is in the second end and the hub is rotated to a position where the recess is not in alignment with the protrusion, the protrusion prevents the hub from being displaced from the second end to the first end; and wherein when the axle is in the second end and the recess is aligned with the protrusion, the spring pulls the axle from the second end to the first end.

14. The apparatus of claim 11, further comprising:

a gripping member attached to the hub such that the wearer can push the gripping member laterally forward, causing the axle to be displaced from the first end to the second end; and wherein the member is the visor locking plate.

15. The apparatus of claim 1, wherein said protrusion is a fixed part of said circular body that is oriented in a fixed direction.

* * * * *